United States Patent [19]

Dennis

[11] Patent Number: 4,640,881

[45] Date of Patent: Feb. 3, 1987

[54] METHOD FOR THE DISPERSEMENT OF MAGNETIC FILLER IN ONE-PART TONER POWDER AND THE COMPOSITION THEREFOR

[75] Inventor: William E. Dennis, Midland, Mich.

[73] Assignee: Dow Corning Corporation, Midland, Mich.

[21] Appl. No.: 755,040

[22] Filed: Jul. 15, 1985

[51] Int. Cl.[4] ..... G03G 9/08; G03G 9/14

[52] U.S. Cl. ..... 430/106.6; 430/137; 430/903; 430/110

[58] Field of Search ..... 430/106.6, 137, 903, 430/110

[56] References Cited

U.S. PATENT DOCUMENTS

| | | | |
|---|---|---|---|
| 3,511,788 | 5/1970 | Keil . | |
| 3,965,022 | 6/1976 | Strong et al. | 430/106.6 |
| 4,517,272 | 5/1985 | Jadwin et al. | 430/137 X |

FOREIGN PATENT DOCUMENTS

| | | | |
|---|---|---|---|
| 53-81125 | 7/1978 | Japan | 430/106.6 |
| 56-150757 | 11/1981 | Japan | 430/106.6 |
| 58-38958 | 3/1983 | Japan | 430/106.6 |

*Primary Examiner*—Roland E. Martin

*Attorney, Agent, or Firm*—Roger H. Borrousch

[57] ABSTRACT

Mixing into a combination of thermoplastic organic resin and magnetic powder used to make a toner, a silanol methylsiloxane resin readily gives a dry toner powder useful in making photocopies.

5 Claims, No Drawings

METHOD FOR THE DISPERSEMENT OF MAGNETIC FILLER IN ONE-PART TONER POWDER AND THE COMPOSITION THEREFOR

BACKGROUND OF THE INVENTION

1. Field of the Invention

This invention relates to a method of making dry toner powders for photocopying machines.

2. Background Information

In the process for the manufacture of dry toner powders for photocopy machines, those which comprise a thermoplastic organic resin and magnetic powder are difficult to make because a high shear is needed to blend the components homogeneously. There is thus a need to find a method to improve the handling or processing of the toner. The present invention is a method of providing the toner without the use of the high shear resulting in a product which is a completely satisfactory homogeneous blend.

Keil in U.S. Pat. No. 3,511,788, issued May 12, 1970, teaches using a copolymer of $SiO_2$ units and units selected from the group consisting of $(CH_3)_3SiO_{\frac{1}{2}}$ and $Q(CH_3)_2SiO_{\frac{1}{2}}$ units, wherein Q is a radical containing a solubilizing group and the ratio of $SiO_2$ units to the total $(CH_3)_3SiO_{\frac{1}{2}}$ and $Q(CH_3)_2SiO_{\frac{1}{2}}$ units is in the range of 1/0.6 to 1/1.2, to mix with organic liquid or plastisol to make a foam. Keil is concerned with liquid systems and foams which are different from the dry toner powders of the present invention.

SUMMARY OF THE INVENTION

This invention relates to a method for making a one-part toner powder for photocopy machines comprising melting a thermoplastic organic resin, adding to the resulting melted thermoplastic organic resin a silanol methylsiloxane resin consisting of siloxane units selected from the group consisting of methylsilsesquioxane unit, dimethylsiloxane unit, trimethylsiloxy unit, and $SiO_2$ unit in which there is at least one siloxane unit having methyl radicals bonded thereto, and then adding magnetic powder, the silanol methylsiloxane resin being present in an amount sufficient to make the magnetic powder oleophilic enough to form a uniform dispersion in the thermoplastic organic resin, dispersing the magnetic powder uniformly, and thereafter making the resulting product into a dry powder suitable as toner for photocopying.

DETAILED DESCRIPTION OF THE INVENTION

Dry toner powders are generally known and many methods of preparation are also known. The particular dry toner powders of interest in this invention are those which comprise a thermoplastic organic resin and magnetic powder. It is these toners which are difficult to make because the magnetic powder is oleophobic and in order to produce a homogeneous blend high shear techniques are required. One method of making the blend with lower shear would be to use an organic solvent but such a method introduces large volumes of solvents which must be dealt with from cost, safety, and environmental aspects, and as such is not a very satisfactory solution.

The particular thermoplastic organic resins of the toner are not part of this invention. The thermoplastic organic resins must have the proper melting and rheological characteristics, must be suitable binding agents for the magnetic powder, must be suitably adherent to the photocopy paper or substrate, and must be sufficiently durable to make the copy last a reasonable length of time. One example of a thermoplastic organic resin is a styrene-acrylate resin.

The magnetic powders of this invention are those which are magnetic and useful in toner powders. The particular kind of magnetic powder is not part of this invention except that it is magnetic and has the proper particle size and distribution to be useful in toners and can be uniformly dispersed. Iron oxide powders are suitable magnetic powders in this invention and are well known in the toner industry. Other magnetic powders which may be useful in this invention are the various finely divided iron metal powders. The particular proportion of thermoplastic organic resin and magnetic powder, such as the iron oxide, are also well known in the toner industry. The iron oxides can be used in amount such as from 60 to 90 weight percent based on the weight of the composition.

In making dry toner powders, the thermoplastic organic resin is first melted. In this invention, there are at least two approaches to making the dry toner powder more easily. One approach is to add to the melted thermoplastic organic resin a silanol methylsiloxane resin. This resin is soluble in organic solvent such as xylene and may be supplied as such. The silanol resin is added to the thermoplastic organic resin in an amount sufficient to make the magnetic powder oleophilic. This amount will preferably be between 0.5 to 5 weight percent based on the weight of the magnetic powder in the toner. After the silanol resin is added, the thermoplastic organic resin melt and resin are mixed to make a homogeneous blend.

The magnetic powder is then added to the blend of the thermoplastic organic resin and silanol resin and dispersed with ease. A homogeneous blend can be obtained with much lower shear than required for compositions without the silanol resin. Preferably, organic solvent present in the silanol resin as supplied should be removed during processing. After the magnetic powder blend is obtained, the dry toner powder can be made by any of the ordinary techniques known to the toner industry.

Another approach to make the toner is to add to the melted thermoplastic organic resin, a magnetic powder which is pretreated with the silanol resin. In this approach, the silanol resin and the magnetic powder are mixed in sufficient amounts to make the magnetic powder oleophilic, the organic solvent is removed by heating the mixture of the resin coated magnetic powder, and the oleophilic magnetic powder is obtained.

The silanol methylsiloxane resin is an organic solvent soluble resin which contains at least one kind of methylsiloxane unit, such as methylsilsesquioxane unit, dimethylsiloxane unit, or trimethylsiloxy unit. The silanol methylsiloxane resin can also contain $SiO_2$ units. The preferred species is a silanol copolymer of trimethylsiloxy units and $SiO_2$ units. The silanol methylsiloxane resin must have sufficient silanol to bond to the magnetic powders of this composition, such contents can range from 0.5 to 10 weight percent based on the weight of the resin.

The preferred silanol methylsiloxane resin is a silanol copolymer which consists essentially of $SiO_2$ units and $(CH_3)_3SiO_{\frac{1}{2}}$ units which are in a ratio of 1/0.9 to 1/1.2. These silanol copolymer are well known in the silicone art and are available commercially. The most common copolymers are available in organic solvent. Such silanol copolymers are described in U.S. Pat. No. 2,676,182 by Daudt and Tyler, issued Apr. 20, 1954. There are many silanol methylsiloxane resins available and many are described throughout the literature.

The preferred compositions of this invention are those which are obtained from a thermoplastic organic resin, iron oxide as the magnetic powder, and the silanol copolymer.

That which is claimed is:

1. A homogeneous blend of a thermoplastic organic resin and a magnetic powder in the presence of an oleophilicizing amount of a silanol methylsiloxane resin consisting of siloxane units selected from the group consisting of methylsilsesquioxane unit, dimethylsiloxane unit, trimethylsiloxy unit, and $SiO_2$ unit in which there is at least one siloxane unit having methyl radicals bonded thereto.

2. A homogeneous blend of a thermoplastic organic resin and an iron oxide powder in the presence of an oleophilicizing amount of a silanol copolymer consisting essentially of $SiO_2$ units and $(CH_3)_3SiO_{\frac{1}{2}}$ units wherein the ratio of the $SiO_2$ units to the $(CH_3)_3SiO_{\frac{1}{2}}$ units is 1/0.9 to 1/1.2.

3. A method for making a one-part toner powder for photocopy machines comprising melting a thermoplastic organic resin, adding to the resulting melted thermoplastic organic resin a silanol methylsiloxane resin consisting of siloxane units selected from the group consisting of methylsilsesquioxane unit, dimethylsiloxane unit, trimethylsiloxy unit, and $SiO_2$ unit in which there is at least one siloxane unit having methyl radicals bonded thereto, and then adding magnetic powder, the silanol methylsiloxane resin being present in an amount sufficient to make the magnetic powder oleophilic enough to form a uniform dispersion in the thermoplastic organic resin, dispersing the magnetic powder uniformly, and thereafter making the resulting product into a dry powder suitable as toner for photocopying.

4. A method for making a one-part toner powder for photocopy machines comprising melting an organic resin, adding to the resulting melted organic resin a silanol copolymer consisting essentially of $SiO_2$ units and $(CH_3)_3SiO_{\frac{1}{2}}$ units in which the ratio of the $SiO_2$ units to $(CH_3)_3SiO_{\frac{1}{2}}$ units is 1/0.9 to 1/1.2, and then adding iron oxide powder, the silanol copolymer being present in an amount sufficient to make the iron oxide powder oleophilic enough to form a uniform dispersion in the organic resin, dispersing the iron oxide powder uniformly, and thereafter making the resulting product into a dry powder suitable as toner for photocopying.

5. A method for making a one-part toner powder for photocopy machines comprising melting an organic resin, adding to the resulting melted organic resin iron oxide powder the surface of which is sufficiently oleophilic to readily disperse in the organic resin and in which the iron oxide is made oleophilic by being coated with a silanol copolymer consisting essentially of $SiO_2$ units and $(CH_3)_3SiO_{\frac{1}{2}}$ units in which the ratio of $SiO_2$ units to $(CH_3)_3SiO_{\frac{1}{2}}$ units is 1/0.9 to 1/1.2, dispersing the iron oxide powder uniformly, and thereafter making the resulting product into a dry powder suitable as toner for photocopying.

* * * * *